US007419117B2

(12) United States Patent
Andreasson et al.

(10) Patent No.: US 7,419,117 B2
(45) Date of Patent: Sep. 2, 2008

(54) APPARATUS FOR WINDING UP A WEB IN ROLLS AND A METHOD FOR CUTTING OFF A LENGTH OF THE WEB

(75) Inventors: Bengt Arne Andreasson, Göteborg (SE); Birger Elmgaard Sørensen, Vejle Ø (DK)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 11/492,483

(22) Filed: Jul. 24, 2006

(65) Prior Publication Data

US 2006/0261208 A1 Nov. 23, 2006

Related U.S. Application Data

(62) Division of application No. 10/467,286, filed as application No. PCT/DK00/00738 on Dec. 28, 2000, now Pat. No. 7,278,602.

(51) Int. Cl.
*B65H 18/14* (2006.01)

(52) U.S. Cl. ..... 242/527.3; 242/541; 242/541.3

(58) Field of Classification Search ..... 242/527, 242/527.2, 527.3, 541, 541.1, 541.3
See application file for complete search history.

(56) References Cited

U.S. PATENT DOCUMENTS

| | | | | |
|---|---|---|---|---|
| 4,431,140 | A | 2/1984 | Tetro | 242/533.4 |
| 4,886,219 | A | 12/1989 | Achterwinter et al. | 242/532 |
| 4,901,934 | A | 2/1990 | Schnell | 242/56 |
| 5,505,403 | A | 4/1996 | Raudaskoski | 242/527.3 |
| 5,725,176 | A | 3/1998 | Vigneau | 242/521 |
| 5,967,449 | A | 10/1999 | Thomas et al. | 242/541.1 |
| 5,988,557 | A | 11/1999 | Moller et al. | 242/532 |

FOREIGN PATENT DOCUMENTS

| | | |
|---|---|---|
| DE | 3217738 | 11/1983 |
| EP | 0 957 054 A1 | 11/1999 |
| GB | 2 091 226 A | 8/1982 |

*Primary Examiner*—Evan H Langdon
(74) *Attorney, Agent, or Firm*—Winston & Strawn LLP

(57) ABSTRACT

The invention provides an apparatus for winding material. The apparatus includes first and second roll carriages that are each configured to support a roll shaft. At least one of the first and second roll carriages is configured to be rotated by a drive member. The apparatus also includes an engagement roller displaceable from a first engagement roller position where the traveling roller is free of a web to a second, different engagement roller position where the traveling roller is configured to engage the periphery of a roll of web material that is at least partially wound about the roll, a traveling roller displaceable from a first traveling roller position to a second traveling roller position and a cutter where the cutter is configured to cut through the web after the first roll carriage moves from a first roll carriage position to a second roll carriage position.

6 Claims, 8 Drawing Sheets

Figure 1:
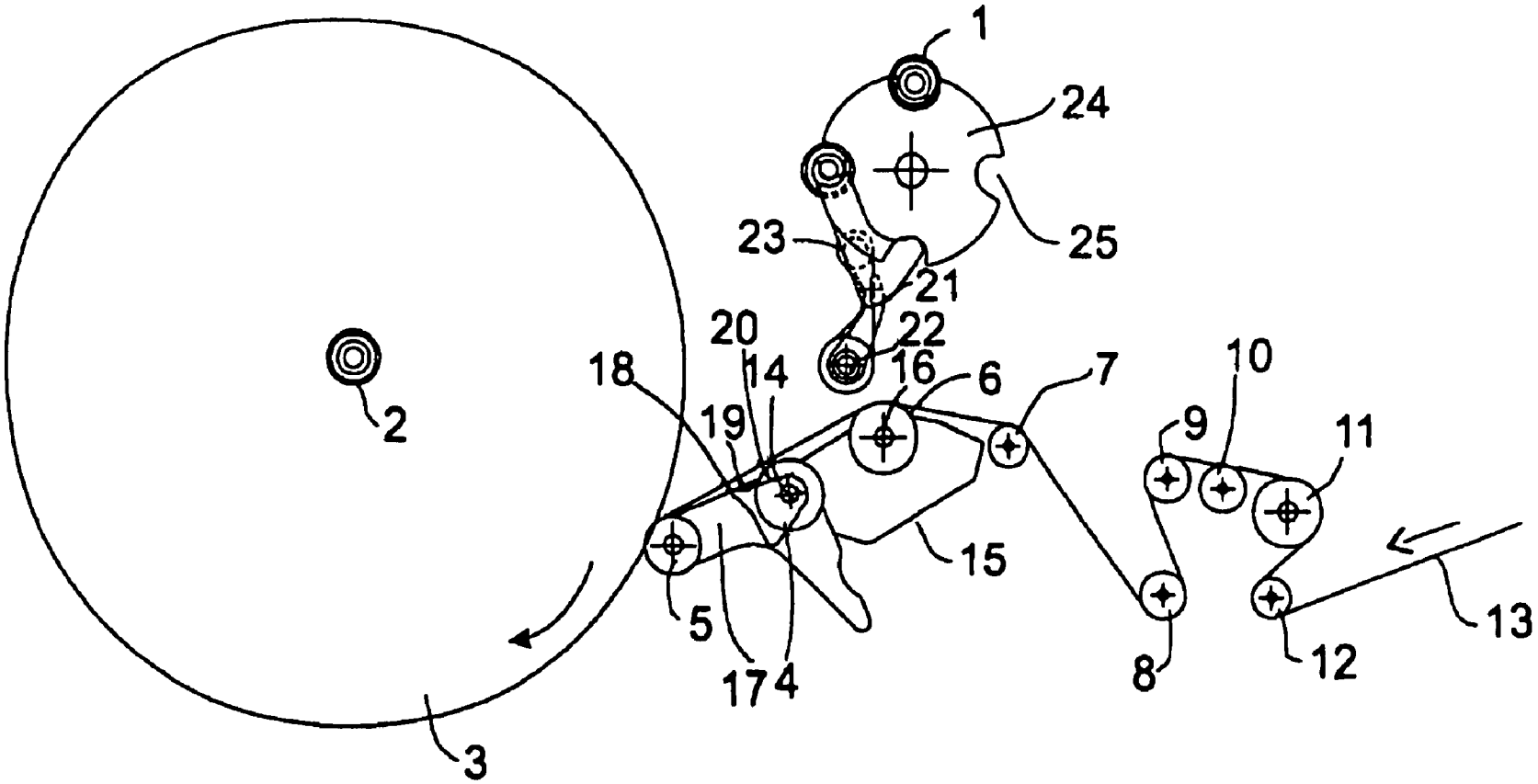

APPARATUS FOR WINDING UP A WEB IN ROLLS AND A METHOD FOR CUTTING OFF A LENGTH OF THE WEB

CROSS-REFERENCE TO RELATED APPLICATIONS

This application is a division of application Ser. No. 10/467,286 filed Apr. 19, 2004 now U.S. Pat. No. 7,278,602, which application is the US national stage of International application PCT/DK00/00738 filed Dec. 28, 2000. The content of each application is expressly incorporated herein by reference thereto.

FIELD OF THE INVENTION

The invention relates to an apparatus for winding up a material web in rolls on roll shafts and also a method for, by operating this apparatus, cutting off a free length of the web.

BACKGROUND OF THE INVENTION

Such material webs, which for example could be air-laid fibre webs, are generally produced continually in plants arranged in such a way that it is not possible to change the production rate of the plant during the winding-up process.

This fact is causing some problems in connection with roll shifting where the web is cut and a new winding-up operation is started on an empty roll shaft while the web at the same time continuously is supplied to the winding-up apparatus.

Problems also are arising at rupture of the web or when starting a new production of web as the supply of the web from the web producing plant to the winding-up apparatus in these cases does not take place in accordance with the usual winding-up cycles.

Many attempts have during the years been made for solving these problems. In these cases, the web roll being wound up is normally conveyed from a start position to a finish position for thereby making room for a new, empty roll shaft brought in position for winding-up a new web roll.

The best result is obtained when the winding-up of the web roll is carried out by means of a center drive, directly rotating the roll shaft, in combination with a periphery drive, acting on the periphery of the web roll.

In a known winding-up apparatus, the winding-up operation is started with a center drive which, when the web roll has reached a suitable size, is taken over or is supplemented by a periphery drive in form of a belt drive placed below the roll.

In another known winding-up apparatus the center drive is taken over or is supplemented by a periphery drive in form of a drive roll acting on the periphery of the web roll.

These known winding-up apparatus suffer, however, of the drawback that it, at e.g. rupture of the web or starting of a new web production, is difficult and complicated to start the winding-up on a new, empty roll shaft as the apparatuses in such situations are not able to impart the necessary web tension to the web to cause the new roll shaft to catch the web. Neither is it possible manually to wrap the web around the old web roll for continuing the winding-up of the web on this roll.

SUMMARY OF THE INVENTION

The invention provides an apparatus of the kind named in the opening paragraph, which has a simple construction and at rupture of the web or starting up of a new web production, easily is able to start the winding-up of the web on a new roll shaft.

Also, the invention provides an apparatus of the kind mentioned in the opening paragraph, which at rupture of the web or starting up of a new web production, allows an operator manually to wrap the web around the old web roll for continuing the winding-up on this roll.

The invention further provides a method of the kind mentioned in the opening paragraph for, by operating the apparatus according to the invention, cutting off a free length of the web.

These features are, according to the invention, attained by providing an apparatus serving for winding up a material web in rolls and comprising two roll carriages, each having supporting structures for supporting the ends of a roll shaft and also rotating means for rotating said shaft during operation, means for conveying each carriage to-and-fro between a start position where the winding-up of a roll of web on an empty shaft is started, and a finish position where the winding up of the roll is finished, a first pressure roller being displaceable between a first position where the roller is supporting the web at a distance from an empty shaft on a carriage being in start position and a second position where the roller is pressing the web against said shaft, a second pressure roller displaceable between a start position where the roller is free of the web and other positions than the start position where the roller is engaging the periphery of a web roll partly or completely wound-up, a cutting knife which is placed in an area between the first and second pressure rollers and is displaceable between a first position at a distance from the web and a second position where the knife has cut through the web, and means for, at roll exchanging, simultaneously or immediately after each other, displacing the first pressure roller and the cutting knife from the first to the second position.

A carriage with an old web roll can by means of this construction advantageously be conveyed towards its finish position without blocking for the access to said web roll.

Another advantage consists in that it is possible to obtain or maintain tension in the web after rupture of this such that a shift to a new shaft can be made in a controlled way.

Still another advantage consist in that an operator at rupture of the web manually is able to wrap the web around a not finished web roll for continuing the winding-up such that the web rupture will be built into the web roll.

In a simple and expedient embodiment of the invention, the first pressure roller is rotatably mounted on a pair of arms, which are pivotally mounted on a frame of the apparatus, while the second pressure roller is rotatably mounted on a second pair of arms, which are pivotally mounted on the first pair of arms and preferably concentric with the rotating axis of the first pressure roller.

According to the invention the cutting knife could be pivotally mounted on the first—or second pair of arms and preferably concentric with the rotating axis of the first—or second pressure roller, respectively.

It is possible to start a new winding-up operation in a safe and reliable way when the winding-up apparatus according to the invention is comprising a wrapping device for, at roll exchanging, wrapping the leading edge of the cut web at least partly around the empty roll shaft.

This advantage could be further improved by means of an endless belt running over two rollers and arranged for being brought into contact with the empty roll shaft at roll exchanging.

The second pressure roller could, according to the invention, be a driving roller for partially or completely rotating a roll of web, partly wound-up, by engaging the periphery of said roll.

Alternatively, the second roller could, according to the invention, be a follower roller, whereby it advantageously is obtained that the roll can be tightened before roll exchanging.

The roll exchanging could, according to the invention, in an easy way be carried out automatically by means of a charging device having a rotatable magazine for holding a number of empty roll shafts and a pivotal charging arm for removing a roll shaft from the magazine and placing it in the supporting structures of a roll carriage being in the start position.

When starting a new web production or at rupture of the web, it could be advantageous or even necessary to cut off a length of the web before starting the winding-up of the web in web rolls, for example if the length of web has defect in material.

This cutting operation could, according to the invention, be carried out by bringing the first pressure roller into its first position, the cutting knife into its first position, the second pressure roller into its first position or a position near this first position, a length of web past the second pressure roller, the second pressure roller to a position other than its first one, and the cutting knife into its second position.

The friction between the rotating second pressure roller and the web will impart this with a tension sufficient for cutting the web. Said friction could be improved by means of a rubber surface on the second pressure roller.

During the cutting-off process, there is a risk that said length of web will wound itself round the second pressure roller. This risk could, according to the invention, be eliminated by acting on the length of web by a force, which e.g., could be jets of air, in an opposite direction of the rotating direction of the second pressure roll.

BRIEF DESCRIPTTION OF THE DRAWING FIGURES

Figure 2:
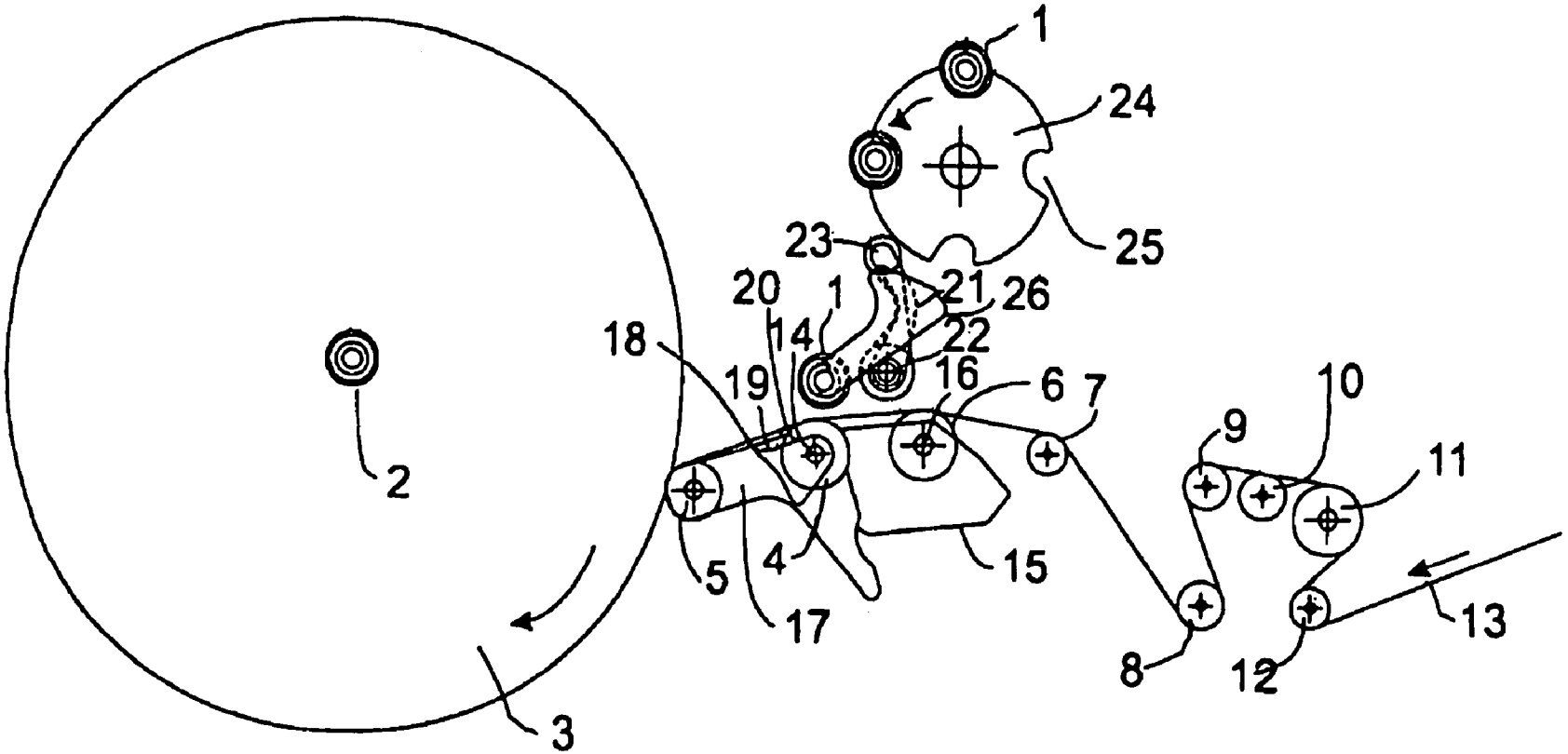
Figure 3:
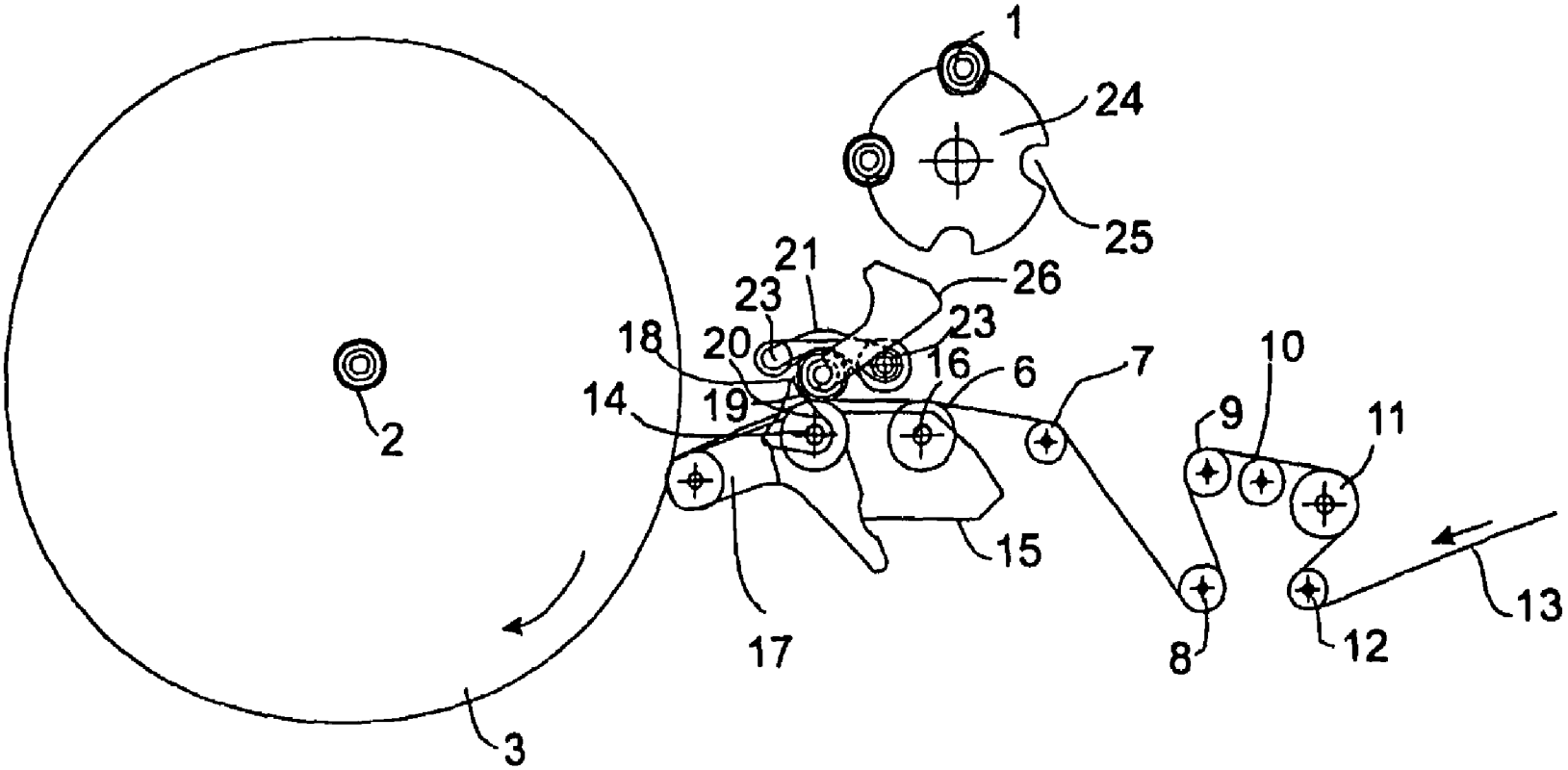
Figure 4:
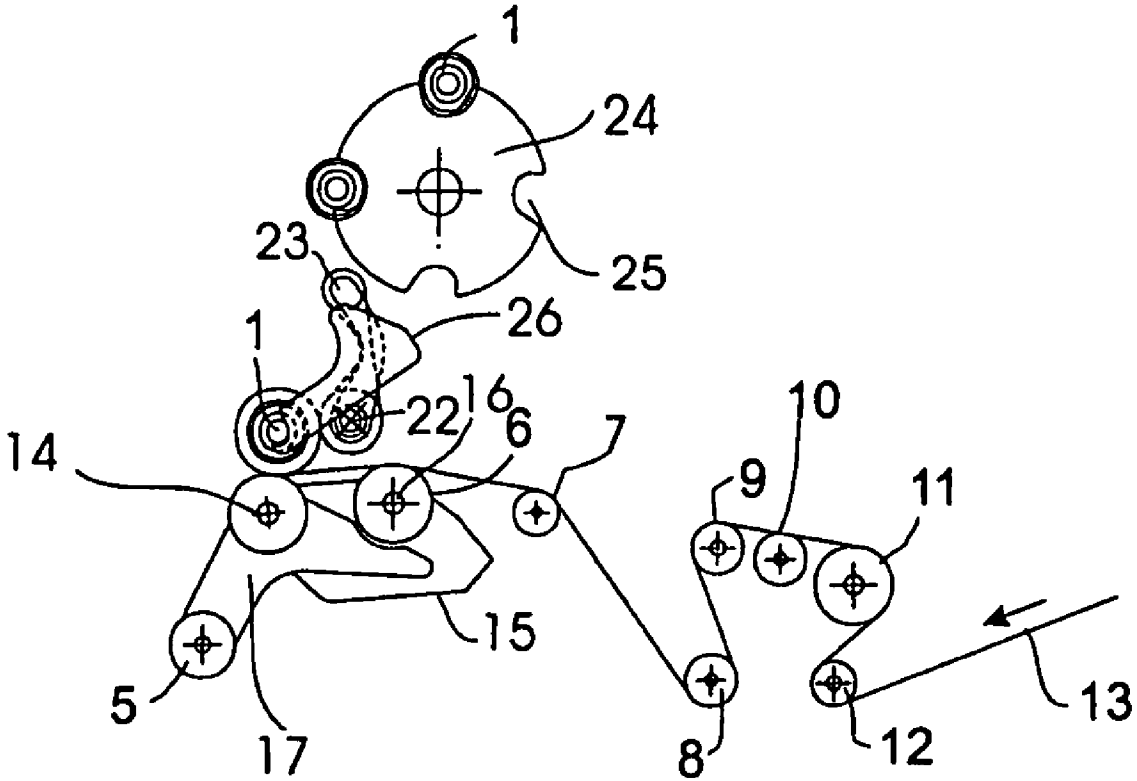
Figure 5:
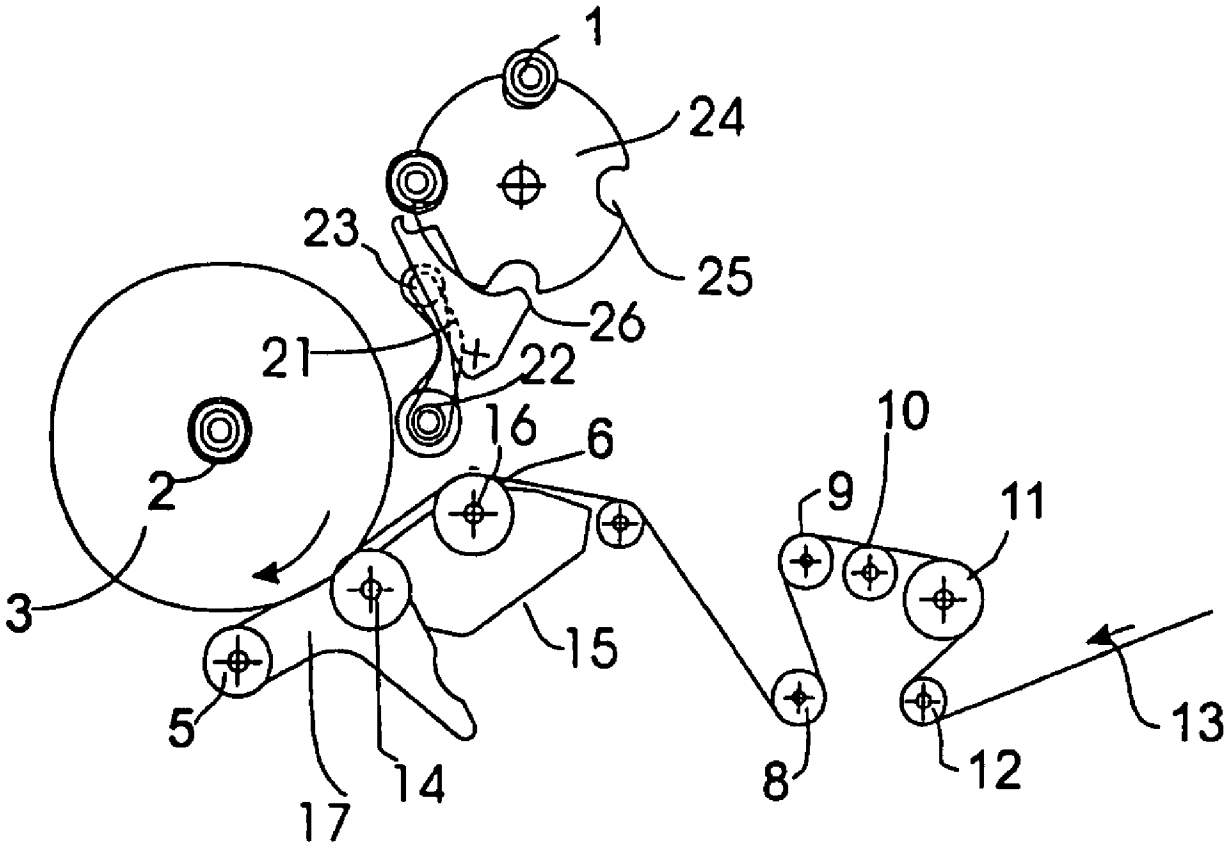
Figure 6:
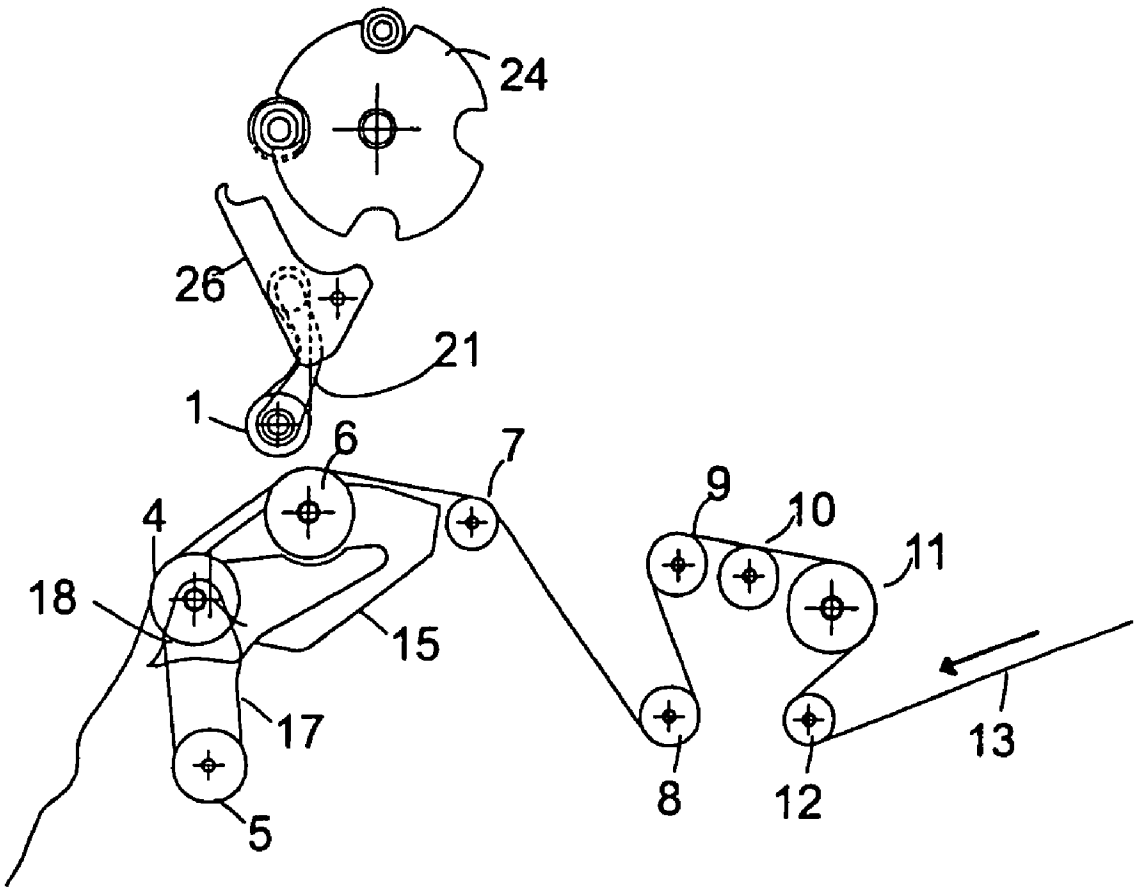
Figure 7:
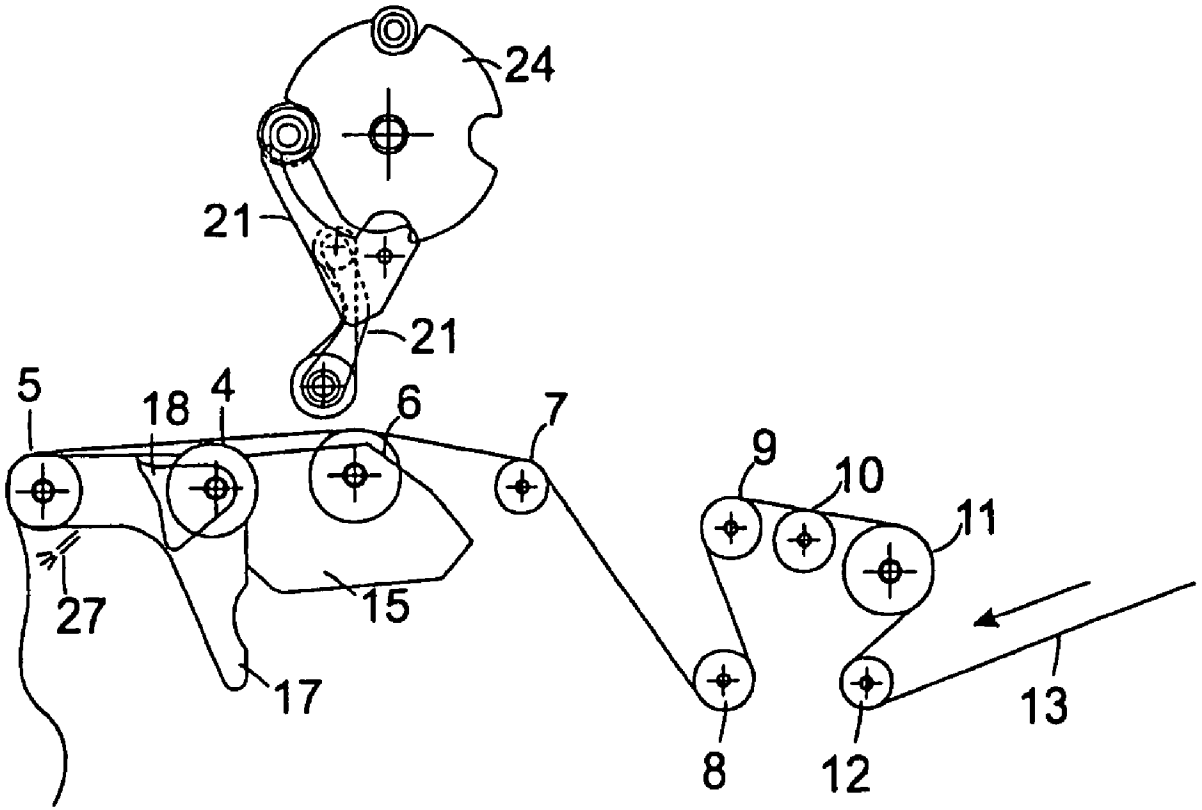
Figure 8:
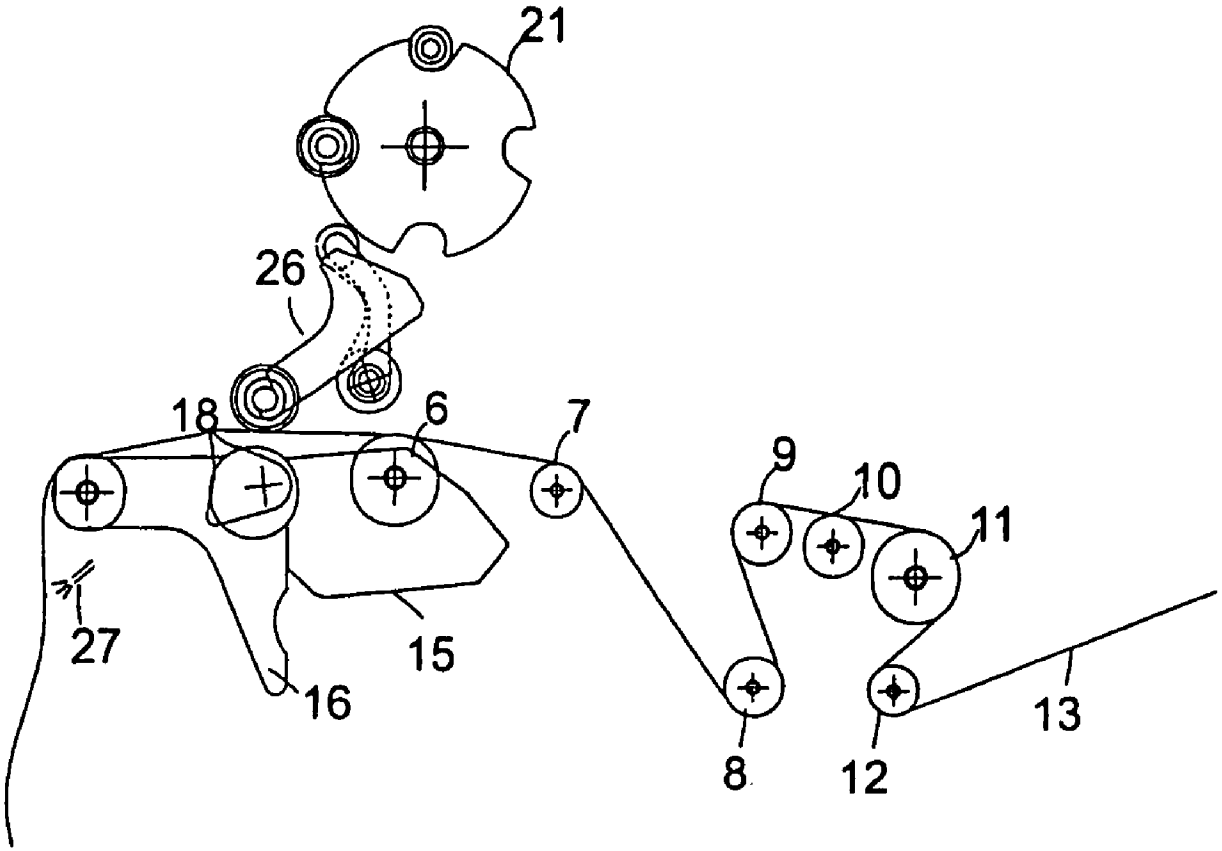

The invention will be explained more fully by the following description of an embodiment, which just serves as an example, with reference to the drawing, in which FIG. 1 is a schematic view of an winding-up apparatus according to the invention in one operation stage, FIG. 2 shows the apparatus in another operation stage, FIG. 3 shows the apparatus in a third operation stage, FIG. 4 shows the apparatus in a forth operation stage, FIG. 5 shows the apparatus in a fifth operation stage, FIG. 6 shows, in a first operation stage, how a length of web is cut off by using the winding-up apparatus according to the invention, FIG. 7 shows the same in a second operation stage, and FIG. 8 shows the same in a third operation stage.

DETAILED DESCRIPTION OF THE PREFERRED EMBODIMENTS

FIGS. 1 to 6 show by way of example a winding-up apparatus according to the invention. The apparatus has a frame (not shown) for mounting the different components of the apparatus, and it comprises two, known per se, roll carriages, which in the drawing only are indicated by a new, empty roll shaft 1 and an old roll shaft 2 bearing a web roll 3.

Each carriage has supporting structures (not shown) for supporting the ends of a roll shaft 1 or 2 and also rotating means (not shown) for rotating the shaft during operation.

The apparatus also has means (not shown) for conveying the carriages between a start position where the winding-up of a roll of web on an empty shaft is started, and a finish position where the winding up of the web roll is finished.

As seen in e.g. FIG. 3, the start position is indicated by the position of the new, empty roll shaft 1, while the finish position is indicated by the position of the roll shaft 2 carrying the finished wound-up web roll 3.

The apparatus further comprises a first pressure roller 4, a second pressure roller 5, a deflecting roller 6 and other deflecting rollers 7 to 12 for leading a web 13 into the apparatus in the direction of the arrow.

The first pressure roller 4 is rotatably mounted about an axis 14 on a first pair of arms 15 which are pivotally mounted on the frame of the apparatus about an axis 16 concentric with the rotation axis of the deflecting roller 6.

The second pressure roller 5 is rotatably mounted on a second pair of arms 17, which are pivotally mounted on the first pair of arms 15 about the axis 14 of the first pressure roller 4.

The apparatus also has driving means as e.g. pneumatic or hydraulic cylinders (not shown) for swinging the first—and second pair of arms 15 and 17 about their axis 16 and 14, respectively, in such a way that the first pressure roller 4 is displaced between a first position at a distance from an new, empty shaft 1 in start position and a second position where the pressure roller 4 is pressing the web 13 against said shaft 1, and the second pressure roller 5 is displaced between a start position where the pressure roller 5 is free of the web 13 and other positions than the start position where the roller 5 is engaging the periphery of a web roll 3 partly or completely wound-up.

Between the first and second pressure rollers 4 and 5, respectively, is arranged a cutting knife 18, which by means of e.g. pneumatic or hydraulic cylinders (not shown) can be displaced between a first position at a distance from the web and a second position where the knife has cut through the web.

The cutting knife 18 is, in the example shown in FIGS. 1 to 6, pivotally mounted on the first pair of arms 15 about the rotating axis 14 of the first pressure roller 4. Alternatively, the cutting knife can be pivotally mounted on the second pair of arms 17 about the rotating axis of the second pressure roller 5 whereby there will be a longer free end of web to be wrapped around the new roll shaft 1 in start position than in the above named case. This situation is not shown in the drawing.

Said wrapping operation is carried out by means of a wrapping device 19, which in this case is pivotally mounted on the first pair of arms 15 about the rotating axis 14 of the first pressure roller 4. On the wrapping device is, close to the knife 18, formed a curved surface 20 for engaging the free end of the web 13 during the wrapping operation.

An endless belt 21, running over two rollers 22 and 23, respectively, is provided for further improving the wrapping operation by being brought into contact with the new, empty roll shaft 1 at roll exchanging.

The apparatus also comprises a charging device consisting of a rotatable magazine 24 for, in holders 25, holding a number of empty roll shafts, and a pivotal charging arm 26 for removing a roll shaft from the magazine and placing it in the supporting structures of a roll carriage being in the start position.

The apparatus is operating in the following way.

A web roll 3 is in FIG. 1 in winding-up position on a roll shaft 2. The winding-up of the web roll is carried out by means of the center drive and the periphery drive of the second pressure roller 5 mounted on the second pair of arms 17 being in one of their other positions, while the first pressure roller 4 is in the first position. The second pressure roller 5 being a driving roller.

In the magazine 24 is, by means of e.g. a crane (not shown), placed two empty roll shafts 1. The charging arm 26 is in position for catching the lowest one of these shafts and the belt 21 has been swung up to a free position.

In FIG. 2 the web roll is nearly finished being wound up and the charging arm 26 is placing a new, empty roll shaft 1 in the start position.

In FIG. 3 the web roll is finished being wound up. The new, empty roll shaft 1 is in start position. The first pressure roller 4 has been displaced from the first position to the second position, thereby pressing the web 13 against the roll shaft 1. The cutting knife 18 has been displaced from the first position to the second position, thereby cutting the web 13. The leading edge of the web 13 has been wrapped somewhat around the roll shaft 1 by means of the wrapping device 19 and the endless belt 21 has been swung down the roll shaft 1 for further wrapping the web 13 around said shaft.

The second pressure roller 5 is, during the above named operations, in engagement with the periphery of the web roll 3 while the first pressure roller 4 engages the roll shaft 1 simultaneously or almost simultaneously with the cutting operation which therefore can be carried out with the necessary tension in the web between the two rollers 4, 5 for cutting the web.

Normally, the web roll will be wound around a core in form of a cardboard tube put on the roll shaft 1. On the cardboard is usually applied a tape with an adhesive for securely bringing the web along when starting the winding-up of a new web roll on the rotating new roll shaft 1.

By using conventional apparatuses, the tape or the adhesive on the tape will be rubbed off, as the web in these cases is contacting the rotating roll shaft before being cut.

This problem is avoided by using the apparatus of the invention as the web 13 is now pressed against the roll shaft at the same moment as the web is cut and wrapped around said roll shaft.

The finished wound-up web roll has in FIG. 4 been removed by means of e.g., a crane (not shown) and a new web roll is in the beginning of the winding-up operation, which in this phase is carried out alone by means of the center drive as the second pressure roller 2 is not in engagement with the periphery of the still small web roll.

The size of the small roll in FIG. 4 has in FIG. 5 increased so much that the second pressure roller is able to engage the periphery of the web roll, now being acted on by means of both a center drive and a periphery drive.

During the winding-up of the web roll both the center drive and the periphery drive can be regulated in such a way that a web can be wound-up with driving forces which just conform to the characteristics of that particular material web thereby securing a perfect quality of the web roll.

Thereby it is an advantage that the periphery drive is acted on the web roll being wound up independent of the weight of this web roll.

The apparatus is constructed in such a way that an operator has free access to a web roll being wound up. At rupture of the web the operator is therefore able to manually wrap the leading edge of the cut web round the web roll for continuing the winding-up such that the web rupture will be built into the finished web roll.

In some cases it could be necessary to cut off a length of a web, for example when starting a new web production or when a length of the web must be rejected owing to imperfections in the material.

FIGS. 6-9 show how this operation is carried out by using the apparatus according to the invention.

The second pressure roll 5 is in FIG. 6 in its start position and the first pressure roll 4 is in its first position where it is not engaging a roll shaft. A free length of web is hanging over the first pressure roller.

The second pressure roller 5 has in FIG. 7 been swung to a higher position where it during the rotating is acting on the web with a frictional force which will tend to twist the web round the second pressure roller 5. This is, however, prevented by ejecting air jets 27 against the back of the web.

As it appears from FIG. 8, said frictional force will cause a sufficient tension in the web for cutting off said free length of web, which then can be removed and rejected.

The second pressure roller could advantageously have a rubber face for increasing the frictional force between the roller and the web.

In the embodiment described above, the second pressure roller 5 was a driving roller. In another embodiment, it could be a follower roller whereby the advantage is obtained that the web roll can be tightened before roll shifting.

What is claimed is:

1. A method for cutting off a free length of a web while winding-up a material web on a roller, which comprises:

conveying a roll shaft from a start position where the winding-up of the material web is initiated, to a finish position where the winding up of the material web in a roll is complete, displacing a first pressure roller, that is rotatably mounted on a first pair of arms, between a first position where the first pressure roller is spaced from the roll shaft in the start position and a second position where the first pressure roller urges the material web against the roll shaft, displacing a second pressure roller, that is rotatably mounted on a second pair of arms, between a start position where the roller is free of the material web and positions other than the start position where the second pressure roller engages a periphery of a partly or completely wound-up material web on a web roll, displacing a cutting knife between a first position at a spaced distance from the web and a second position where the knife cuts through the web, and simultaneously or sequentially displacing the first pressure roller and the cutting knife from the first to the second position to transfer the web from the partly or completely wound-up web roll to an empty roll shaft, wherein the second pair of arms are pivotably mounted on the first pair of arms.

2. The method of claim 1, which further comprises cutting the material web as the material web is acted upon by a force that prevents the web from twisting around the second pressure roller.

3. A method for cutting off a free length of a web while winding-up a material web on a roller, which comprises:

conveying a roll shaft from a start position where the winding-up of the material web is initiated, to a finish position where the winding up of the material web in a roll is complete, displacing a first pressure roller between a first position where the first pressure roller is spaced from the roll shaft in the start position and a second position where the first pressure roller urges the material web against the roll shaft, displacing a second pressure roller between a start position where the roller is free of the material web and positions other than the start position where the second pressure roller engages a periphery of a partly or completely wound-up material web on a web roll, displacing a cutting knife between a first position at a spaced distance from the web and a second position where the knife cuts through the web, simultaneously or sequentially displacing the first pressure roller and the cutting knife from the first to the second position to transfer the web from the partly or completely wound-up web roll to an empty roll shaft, and cutting the material web as the material web is acted upon by a force that prevents the web from twisting around the second pressure roller, wherein the force is provided by air jets.

4. A method for cutting off a free length of a web while operating an apparatus for winding-up a material web in rolls on roll shafts, which comprises:

providing two roll carriages, each having supporting structures for supporting roll shafts thereon and a drive mechanism for rotating the roll shafts during operation, conveying each carriage to-and-fro between a start position where the winding-up of a roll of a web on an empty shaft is initiated, and a finish position where the winding up of the roll is complete, displacing a first pressure roller, that is rotatably mounted on a first pair of arms, between a first position where the roller is supporting the web at a distance from an empty shaft on a roll carriage in the start position and a second position where the first pressure roller urges the web against the empty shaft, displacing a second pressure roller, that is rotatably mounted on a second pair of arms, between a start position where the roller is free of the web and positions other than the start position where the second pressure roller engages a periphery of a partly or completely wound-up web roll, displacing a cutting knife between a first position at a spaced distance from the web and a second position where the knife cuts through the web, and simultaneously or sequentially displacing the first pressure roller and the cutting knife from the first to the second position to transfer the web from the partly or completely wound-up web roll to an empty roll shaft, wherein the second pair of arms are pivotably mounted on the first pair of arms.

5. The method of claim 4, wherein the web, during cutting, is acted upon by a force that prevents the web from twisting around the second pressure roller.

6. A method for cutting off a free length of a web while operating an apparatus for winding-up a material web in rolls on roll shafts, which comprises:

providing two roll carriages, each having supporting structures for supporting roll shafts thereon and a drive mechanism for rotating the roll shafts during operation, conveying each carriage to-and-fro between a start position where the winding-up of a roll of a web on an empty shaft is initiated, and a finish position where the winding up of the roll is complete, displacing a first pressure roller between a first position where the roller is supporting the web at a distance from an empty shaft on a roll carriage in the start position and a second position where the first pressure roller urges the web against the empty shaft, displacing a second pressure roller between a start position where the roller is free of the web and positions other than the start position where the second pressure roller engages a periphery of a partly or completely wound-up web roll, displacing a cutting knife between a first position at a spaced distance from the web and a second position where the knife cuts through the web, and simultaneously or sequentially displacing the first pressure roller and the cutting knife from the first to the second position to transfer the web from the partly or completely wound-up web roll to an empty roll shaft, wherein the web, during cutting, is acted upon by a force that prevents the web from twisting around the second pressure roller, wherein the force is provided by air jets.

* * * * *